US006482017B1

(12) United States Patent
Van Doorn

(10) Patent No.: US 6,482,017 B1
(45) Date of Patent: Nov. 19, 2002

(54) EMI-SHIELDING STRAIN RELIEF CABLE BOOT AND DUST COVER

(75) Inventor: Schelto Van Doorn, San Jose, CA (US)

(73) Assignee: Infineon Technologies North America Corp., San Jose, CA (US)

( * ) Notice: Subject to any disclaimer, the term of this patent is extended or adjusted under 35 U.S.C. 154(b) by 0 days.

(21) Appl. No.: 09/576,106

(22) Filed: May 22, 2000

Related U.S. Application Data

(60) Provisional application No. 60/181,969, filed on Feb. 10, 2000.

(51) Int. Cl.[7] ..... H01R 4/58

(52) U.S. Cl. ..... 439/89; 439/149; 439/278; 439/523; 439/588

(58) Field of Search ..... 439/86, 588, 149, 439/278, 281, 523, 521, 89, 282, 447; 385/86–87

(56) References Cited

U.S. PATENT DOCUMENTS

| | | | | |
|---|---|---|---|---|
| 5,141,770 A | 8/1992 | Benn, Sr. et al. | ..... | 427/58 |
| 5,631,443 A | 5/1997 | Scrimpshire et al. | ..... | 385/92 |
| 5,710,851 A | 1/1998 | Walter et al. | ..... | 385/86 |
| 5,864,468 A | 1/1999 | Poplawski et al. | ..... | 361/753 |
| 5,879,173 A | 3/1999 | Poplawski et al. | | |
| 5,886,294 A | 3/1999 | Scrimpshire et al. | ..... | 174/35 R |
| 5,915,056 A | 6/1999 | Bradley et al. | ..... | 385/76 |
| 5,955,703 A | 9/1999 | Daly et al. | | |
| 5,966,487 A | 10/1999 | Gilliland et al. | ..... | 385/92 |
| 6,000,856 A | 12/1999 | Yunker | ..... | 385/75 |
| 6,138,347 A * | 10/2000 | Persson et al. | ..... | 29/836 |
| 6,139,354 A * | 10/2000 | Broussard | ..... | 439/447 |

* cited by examiner

*Primary Examiner*—Gary F. Paumen
*Assistant Examiner*—Felix O. Figueroa
(74) *Attorney, Agent, or Firm*—Fish & Richardson P.C .

(57) ABSTRACT

EMI-shielding strain relief boots and dust covers and methods of using these boots and dust covers are described. An inventive EMI-shielding strain relief boot includes a flexible elongated boot body and an EMI shield. The boot body has a proximal end, a distal end, and an inner surface defining a bore sized and arranged to contain an end portion of a transmission cable and an associated cable connector. The EMI shield extends along a substantial length of the boot body and is configured to shield a region of the bore from interfering electromagnetic radiation. The distal end of the boot body is slidable over the cable connector and is conformable to and envelopable about at least a portion of a pluggable transceiver connector. The dust cover has a flexible elongated dust cover body and an EMI shield. An inventive EMI-shielding dust cover body has a proximal end, a distal end, and an inner surface defining a bore sized and arranged to contain a flange protruding from an opening in an electronic apparatus enclosure. The EMI shield extends along a substantial length of the dust cover body and is configured to shield a region of the bore from interfering electromagnetic radiation. The distal end of the dust cover body is conformable to and envelopable about the flange protruding from the opening in the electronic apparatus enclosure.

30 Claims, 7 Drawing Sheets

EMI-SHIELDING STRAIN RELIEF CABLE BOOT AND DUST COVER

CROSS-REFERENCE TO RELATED APPLICATIONS

This application claims the benefit of U.S. Provisional Application No. 60/181,969, filed Feb. 10, 2000.

TECHNICAL FIELD

This invention relates to strain relief cable boots and dust covers designed to shield against electromagnetic interference (EMI) generated by high-speed data communication modules, computers and peripheral devices.

BACKGROUND

Transmission cables may be used to transmit data between workstations, mainframes and other computers, as well as provide data connections to mass storage devices and other peripheral devices. Data may be transferred using a variety of transmission cable technologies, including multimode optical fiber cables, single mode optical fiber cables, and copper cables (e.g., twinax and coax copper cables). Standard pluggable transceiver modules have been developed to transition between different transfer media and the electronic components inside a computer or peripheral device. A pluggable transceiver module produces a standardized output in accordance with prescribed protocols, regardless of the medium (e.g., optical fiber or copper) through which the data is transmitted or received. A transceiver module typically plugs into a transceiver receptacle that extends out of the rear panel of a computer or peripheral device. The transceiver receptacle connects the transceiver module to a motherboard or circuit card in the computer or peripheral device.

Strain relief systems generally protect transmission cables against the stresses that might result during handling of the cables. In particular, strain relief systems protect against stresses that otherwise might impair the signal transmission properties of the cables. Fiber optic cables are especially vulnerable to damage caused by overstressing or kinking, especially near the cable connectors. A typical strain relief system includes an elongated boot that extends proximally from the proximal end of the cable connector. The boot surrounds the cable and confines it to a prescribed bend radius range, thereby protecting the cable from excessive bending in the region of the cable-connector interface. The boot may guide the cable proximally from the connector in either a straight or a curved path.

Many computers and other high-speed electronic equipment produce significant amount of electromagnetic radiation. As a result, such equipment typically is housed inside enclosures that are designed to contain the electromagnetic interference (EMI) emissions from the electronic equipment. Significant EMI levels, however, may be released through transceiver receptacle openings in the electromagnetically shielded enclosures. EMI also is generated by the transceiver modules that plug into the receptacle openings. Various complex techniques for reducing the total EMI levels generated at the respective interfaces between the electromagnetically shielded enclosure, the pluggable transceiver module and the transmission cable have been proposed.

SUMMARY

The invention features an EMI-shielding strain relief boot and an EMI-shielding dust cover.

In one aspect of the invention, an EMI-shielding strain relief boot includes a flexible elongated boot body and an EMI shield. The boot body has a proximal end, a distal end, and an inner surface defining a bore sized and arranged to contain an end portion of a transmission cable and an associated cable connector. The EMI shield extends along a substantial length of the boot body and is configured to shield a region of the bore from interfering electromagnetic radiation. The distal end of the boot body is slidable over the cable connector and is conformable to and envelopable about at least a portion of a pluggable transceiver connector.

In another aspect, the invention features an EMI-shielding strain relief boot having a flexible elongated boot body and an inner surface defining a bore with a uniform radial dimension. The thickness between the inner surface and an exposed outer surface of the boot body tapers from a central longitudinal region toward the proximal end of the boot body and toward the distal end of the boot body. The boot also includes a flexible electromagnetic interference (EMI) shield that extends along a substantial length of the boot body to an exposed surface of the distal end of the boot body. The EMI shield is formed from an electrically conductive material and is configured to shield a region of the bore from interfering electromagnetic radiation.

Embodiments may include one or more of the following features.

The boot body preferably is configured to limit the bend radius of the transmission cable near the cable connector. The boot may include a proximal flange coupled to the proximal end of the boot body and defining an opening sized to engage the cable connector while accommodating the end portion of the transmission cable. The boot body may include an exposed outer surface with one or more gripping features. A distal flange may protrude outwardly away from the bore. The distal end of the boot body may have an inner surface that flares outwardly away from the bore. The bore may define a curved path through which the transmission cable may extend.

The EMI shield preferably extends to an exposed surface of the distal end of the boot body. The EMI shield preferably comprises an electrical conductor (e.g., a plurality of electrically conductive particles, or a plurality of electrically conductive wires). The EMI shield may be incorporated into the boot body. The EMI shield may include an electrically conductive layer disposed on the inner surface of the boot body. The EMI shield may include magnetic material. The boot body preferably comprises an elastomer.

In another aspect, the invention features a data transmission system, comprising: a pluggable transceiver and an associated transceiver connector; a transmission cable and an associated cable connector sized and arranged to engage the pluggable transceiver connector; and one of the above-defined strain relief boots. The distal end of the boot body is slidable over the cable connector and is conformable to and envelopable about an interface between the transmission cable connector and about the pluggable transceiver connector.

The pluggable transceiver preferably is insertable into a transceiver receptacle having a proximal end defining an opening for receiving the pluggable transceiver. The distal end of the boot body is slidable over the cable connector and is conformable to and envelopable about the proximal end of the transceiver receptacle.

In another aspect, the invention features a method of electromagnetically shielding an opening in an electronic apparatus enclosure. In accordance with this inventive method, an electromagnetic interference shielding strain relief cable boot is attached over a flange protruding from the opening in the electronic apparatus enclosure.

In another aspect of the invention, the dust cover has a flexible elongated dust cover body and an EMI shield. The dust cover body has a proximal end, a distal end, and an inner surface defining a bore sized and arranged to contain a flange protruding from an opening in an electronic apparatus enclosure. The EMI shield extends along a substantial length of the dust cover body and is configured to shield a region of the bore from interfering electromagnetic radiation. The distal end of the dust cover body is conformable to and envelopable about the flange protruding from the opening in the electronic apparatus enclosure.

Among the advantages of the invention are the following.

The inventive strain relief boots protect transmission cables from damage that might be caused by overstressing or kinking. At the same time, these strain relief boots enable a user to quickly and easily extend the electromagnetic shielding properties of an electromagnetically shielded electronic equipment enclosure to the respective interfaces between the transmission cable, a pluggable transceiver module and a transceiver receptacle extending through the enclosure. The inventive EMI-shielding strain relief boot and dust cover provide relatively inexpensive ways to effectively protect against interfering electromagnetic radiation generated near the pluggable transceiver openings in electronic apparatus enclosures.

Other features and advantages of the invention will become apparent from the following description, including the drawings and the claims.

DETAILED DESCRIPTION

Figure 1A:
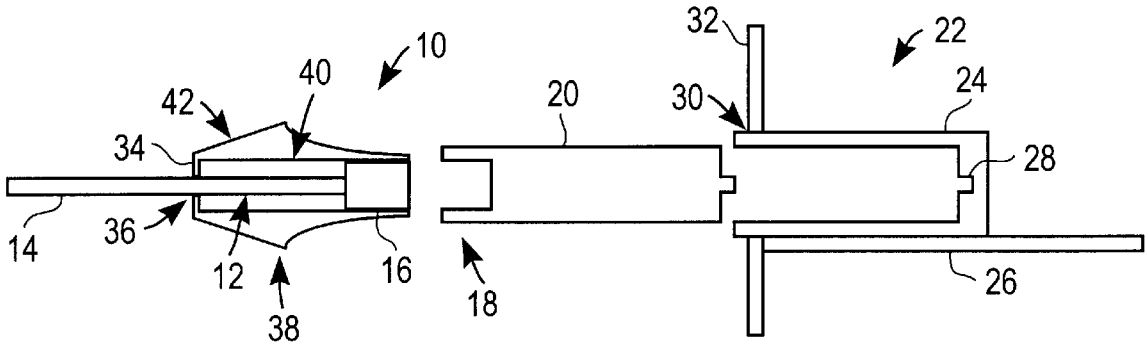
FIG. 1A. is a diagrammatic exploded cross-sectional side view of a transceiver module, a transceiver receptacle that extends out of the rear panel of an electronic equipment enclosure, and an EMI-shielding strain relief boot disposed over a transmission cable.
Figure 1B:
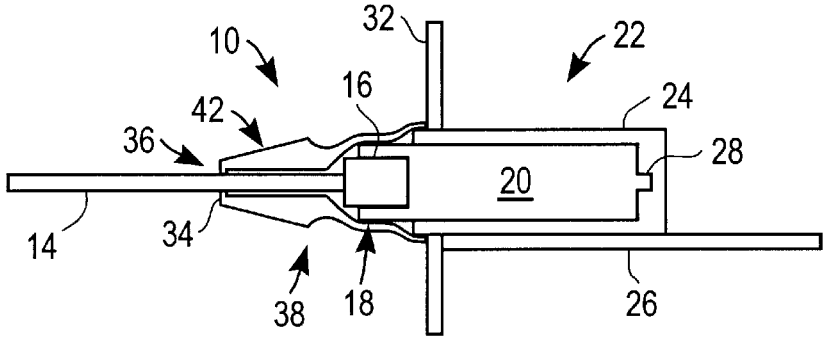
FIG. 1B is a diagrammatic cross-sectional side view of the transmission cable, transceiver module and transceiver receptacle of FIG. 1A connected together with the EMI-shielding strain relief boot disposed over the respective interfaces between the transmission cable, transceiver module and transceiver receptacle.

Referring to FIGS. 1A and 1B, in one embodiment, an EMI-shielding strain relief boot (hereinafter "boot") 10 is disposed over an end portion 12 of a transmission cable 14 and an associated cable connector 16. Cable connector 16 is configured to plug into a mating connector 18 of a pluggable transceiver module 20 that, in turn, is configured to plug into a receptacle assembly 22. Receptacle assembly 22 includes a transceiver receptacle 24 mounted on a circuit card (or motherboard) 26, and a circuit card (or host interface) connector 28 that electrically connects transceiver module 20 to circuit card 26. Transceiver receptacle 24 extends through a mounting panel opening 30 in a rear panel 32 of an electromagnetically shielded electronic equipment enclosure. Transceiver module 20 is configured to transition between circuit card 26 and the transfer medium of transmission cable 14.

Boot 10 may be used with a variety of different transfer media and media connectors. For example, transmission cable 14 may be an optical fiber cable (e.g., a single mode or a multimode optical fiber cable) or an electrical (copper) cable (e.g., a twinax or a coax copper cable). Cable connector 16 and transceiver connector 18 may conform to any one of a variety of optical and copper interface standards, including HSSDC2-type, RJ-type, SC-type, SG-type, ST-type and LC-type connectors, ribbon cable connectors, and twinax and coaxial cable connectors (e.g., SMA connectors). Transceiver receptacle 24 also may conform to a variety of host interface standards, including the MIA (Media Interface Adapter) standard and the recently proposed MSA standard.

As shown in FIG. 1B, in operation, transceiver module 20 plugs into transceiver receptacle 24 and cable connector 16 plugs into transceiver module connector 18. After cable connector 16 is properly coupled to transceiver connector 18, the distal end of boot 10 slides over cable connector 16 and over at least a portion of transceiver connector 18, up to the rear face of rear panel 32. As shown, the distal end of boot 10 is conformable to and envelopable about the proximal end of transceiver connector 18 and about the proximal end of transceiver receptacle 24. Boot 10 includes a proximal flange 34 that is coupled to the proximal end of the body of boot 10. Proximal flange 34 defines an opening 36 sized to engage the proximal face of cable connector 16 while accommodating end portion 12 of transmission cable 14. Proximal flange 34 thereby prevents boot 10 from accidentally being pulled off the distal end of transmission cable 14.

As explained in detail below, boot 10 includes an EMI shield that extends along a substantial length of boot 10. EMI shield also is configured to shield the respective interfaces between transmission cable 14, transceiver module 20 and transceiver receptacle 24. The EMI shield includes and electrical conductor that extends up to an exposed surface of the distal end of boot 10 where it electrically couples to transceiver receptacle 24. The EMI shield also electrically couples to transceiver module 20 through the exposed surfaces of transceiver connector 18. In this way, boot 10 extends the electrical shielding properties of the electronic equipment enclosure by shielding mounting panel opening 30, the protruding ends of transceiver receptacle 24 and the respective interfaces between transmission cable 14, transceiver module 20 and transceiver receptacle 24. In the absence of such EMI shielding by boot 10, each of these interface features would emit interfering electromagnetic radiation in the vicinity of mounting panel opening 30. In addition to its EMI-shielding properties, boot 10 prevents transmission cable 14 from bending near cable connector 16 beyond a prescribed critical bend radius (e.g., about 2.5 cm for an optical fiber transmission cable). In this way, boot 10 protects transmission cable 14 from damage that otherwise might be caused during handling (e.g., overstressing or kinking of transmission cable 14).

The EMI-shielding and strain relief functions of boot 10 are enabled by tapering the radial thickness of boot 10 from a central region 38 toward the proximal end of boot 10 and toward the distal end of boot 10. As used herein, the term "radial thickness" refers to the boot thickness between the inner, bore-defining surface and the exposed outer surface. In this embodiment, the boot body has an inner surface 40 that defines a bore with a substantially uniform radial dimension from the proximal end to the distal end. An exposed outer boot surface 42 diverges outwardly from the proximal end of boot 10 toward central region 38, and converges from central region 38 toward the distal end of boot 10. As shown, outer surface 42 diverges linearly toward central region 38, and converges more rapidly away from central region 38 (e.g., exponentially or in accordance with a polynomial function). By this design, boot 10 is relatively stiff near central region 38 and, therefore, highly resistant to lateral stresses. In the proximal and distal tapered sections, the resistance to lateral stresses gradually decreases towards the proximal and distal ends of boot 10. Central region 38 and the proximal tapered section prevent transmission cable 14 from bending too sharply near cable connector 16. The tapering of the distal section enables the distal end of boot 10 to slide over, envelop and conform to transceiver module connector 18 and to the end of transceiver receptacle 24 and, thereby, enabling boot 10 to shield the respective interfaces between transmission cable 14, transceiver module 20 and transceiver receptacle 24.

In one embodiment, boot 10 has an overall length of about 5 cm to about 10 cm, where the proximal section is about 3 cm to about 9 cm and the distal section is about 1 cm to about 2 cm. The proximal cable opening 36 is approximately 1–2 cm in diameter.

Figure 2A:
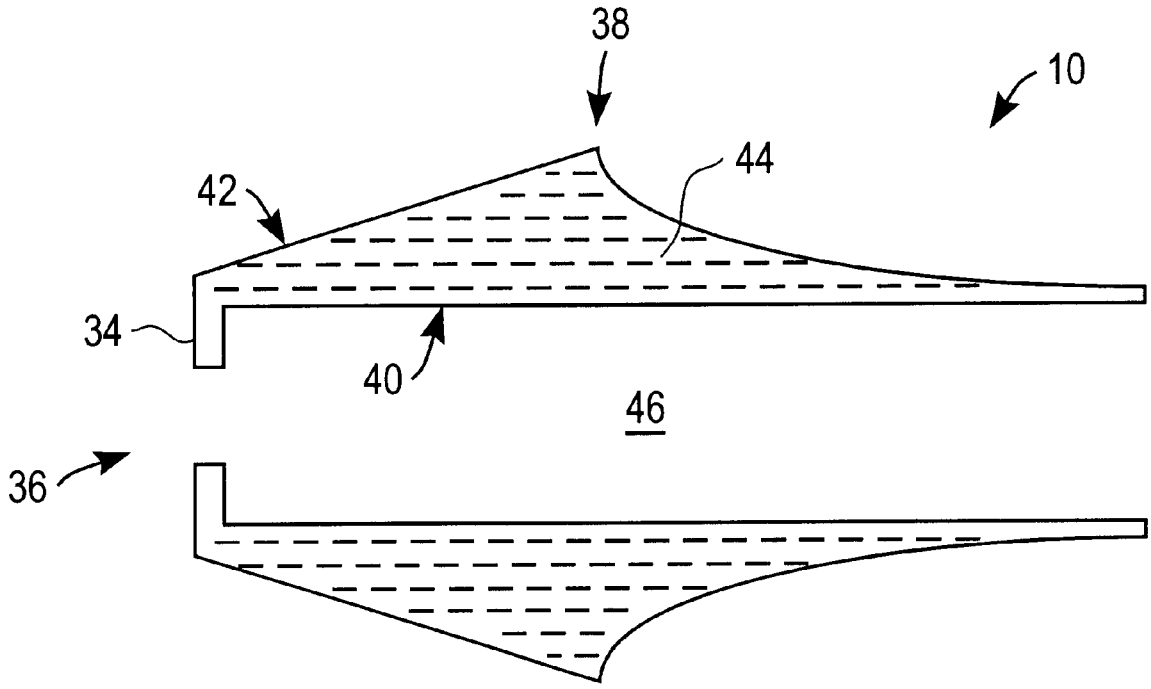
FIG. 2A is a diagrammatic cross-sectional side view of the EMI-shielding strain relief boots of FIGS. 1A and 1B.
Figure 2B:
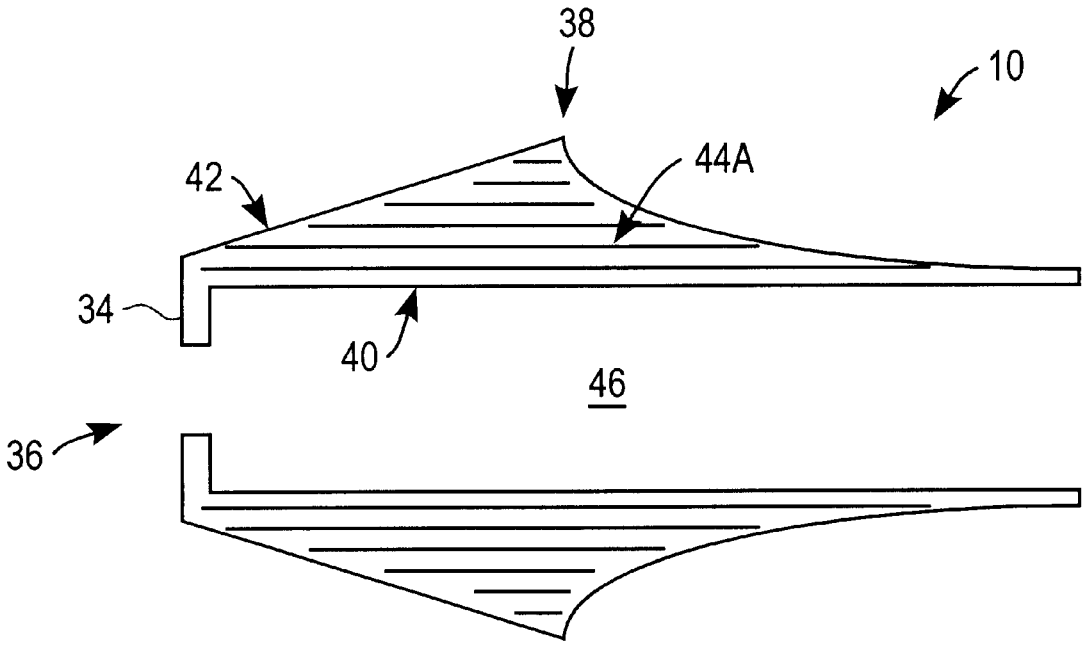
FIG. 2B us a diagrammatic cross-sectional side view of an alternative EMI-shielding strain relief boot.
Figure 2C:
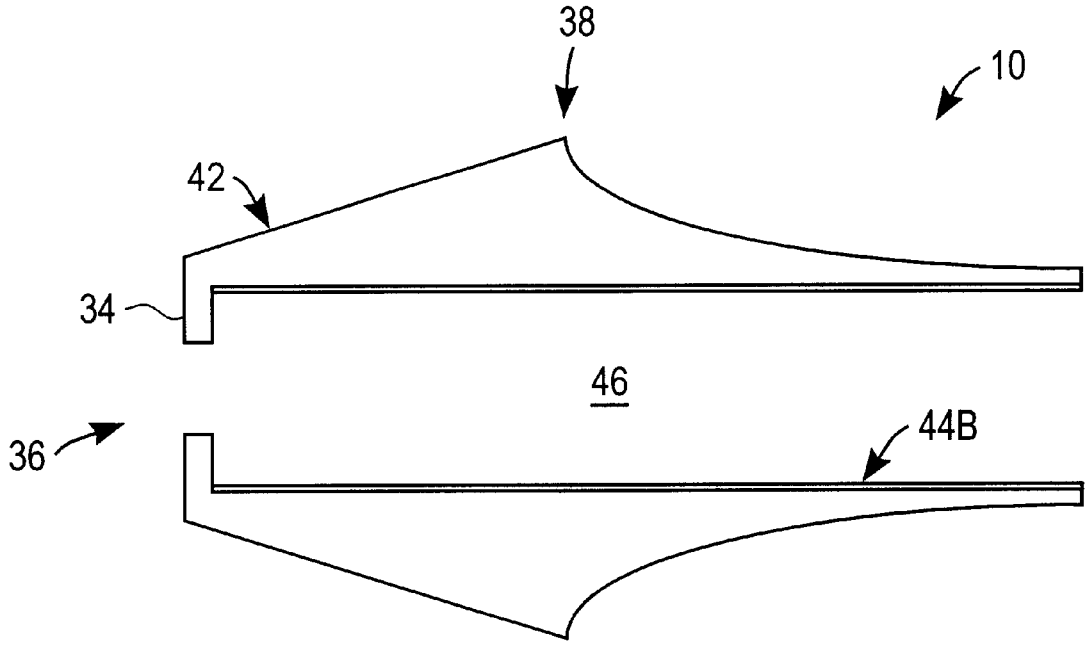
FIG. 2C is a diagrammatic cross-sectional side view of an alternative EMI-shielding strain relief boot.

As shown diagrammatically in FIG. 2, boot 10 includes an EMI shield 44 that extends along a substantial length of the body of boot 10 to shield a region of the bore 46 from interfering electromagnetic radiation. EMI shield 44 is configured to shield against EMI by reflecting or absorbing interfering electromagnetic radiation. EMI shield 44 may include an electrical conductor, such as a plurality of electrically conductive particles (or powder) incorporated in the body of boot 10, or a plurality of electrically conductive wires extending through the body of boot 10. In one embodiment, EMI shield includes magnetic material (e.g., ferrite particles) incorporated in the body of boot 10. Alternatively, EMI shield 44 may include an electrically conductive layer disposed on inner surface 40. The body of boot 10 is formed from a flexible material (e.g., an elastomer, such as rubber or other elastomeric polymer).

Figure 3A:
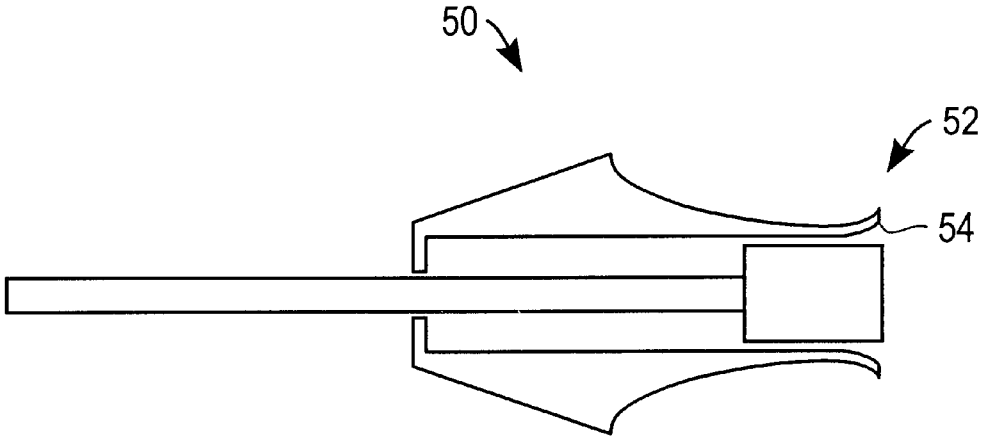
FIG. 3A is a diagrammatic cross-sectional side view of an alternative EMI-shielding strain relief boot disposed about a transmission cable and an associated cable connector.
Figure 3B:
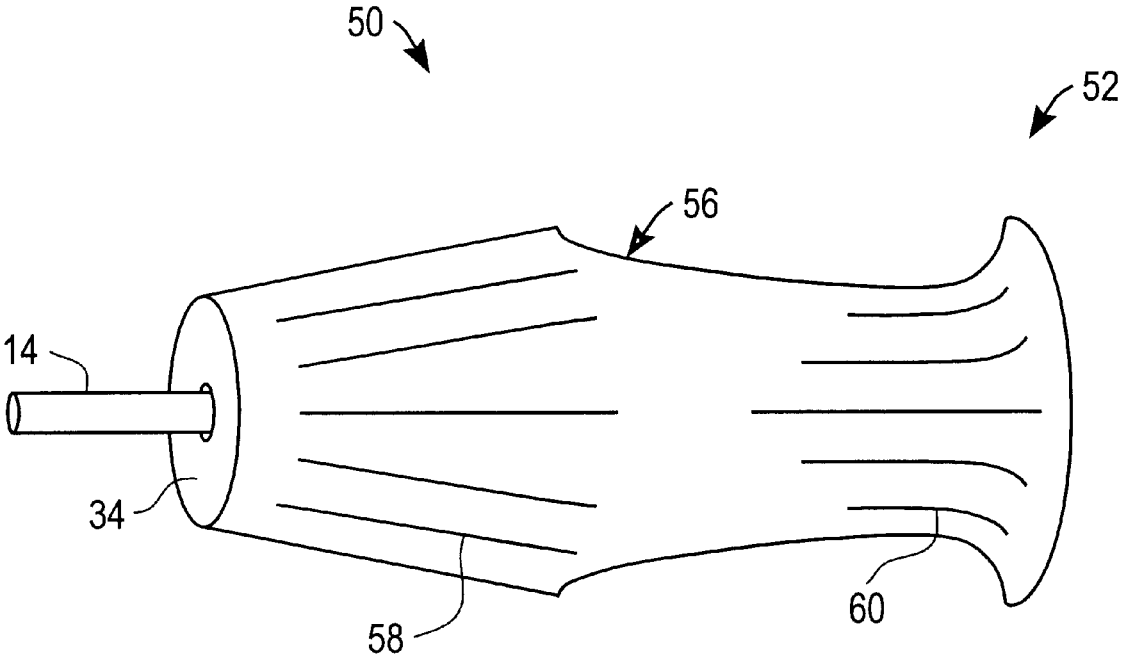
FIG. 3B is a diagrammatic perspective view of the transmission cable and EMI-shielding strain relief boot of FIG. 3A.

Referring to FIGS. 3A and 3B, in another embodiment, an EMI-shielding strain relief boot 50 includes a flared distal end 52 with an inner surface 54 that diverges outwardly. Flared distal end 52 may enhance the slidability of distal end 52 over transceiver module connector 18 and the end of transceiver receptacle 24. As shown in FIG. 3B, an exposed outer surface 56 of boot 50 includes one or more proximal and distal gripping features 58, 60, respectively. Gripping features 58, 60 may include a series of longitudinal slots or rails, or may include an outer gripping layer with an enhanced friction surface. Gripping features 58, 60 may help a user to manipulate boot 50 during installation and removal of boot 50 over the ends of transceiver connector 18 and transceiver receptacle 24.

Figure 4:
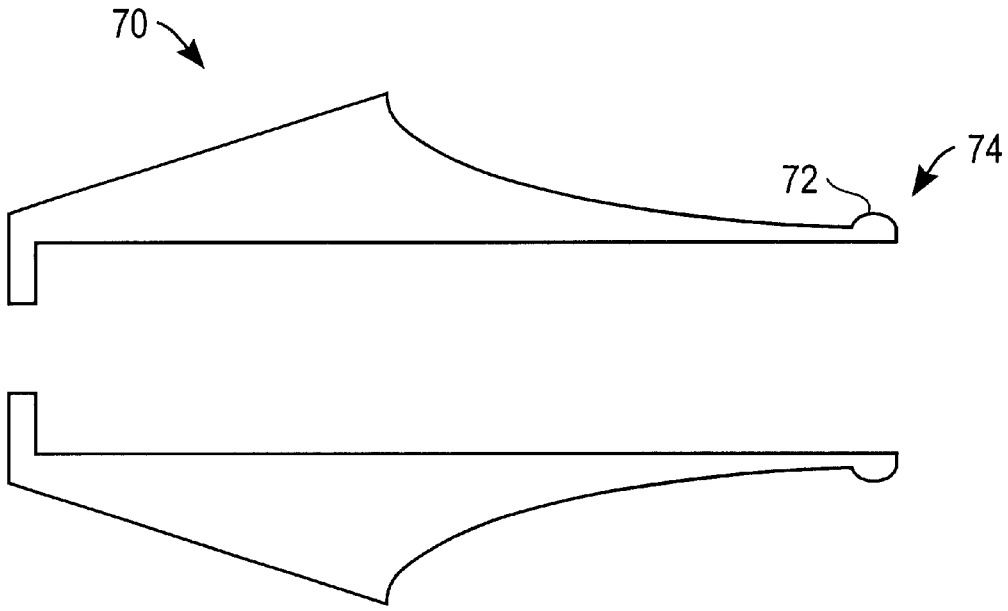
FIGS. 4 and 5 are diagrammatic cross-sectional side views of alternative EMI-shielding strain relief boots.

Referring to FIG. 4, in another embodiment, an EMI-shielding strain relief boot 70 includes a distal flange 72 that protrudes outwardly from a distal end 74 of boot 70. Flange 72 may be formed integrally with boot 70, or it may be formed from an electrically conductive material (e.g., a metal frame or ring) that is electrically coupled to the EMI shield. Flange 72 may enhance the slidability of distal end 74 over transceiver module connector 18 and the end of transceiver receptacle 24.

Figure 5:
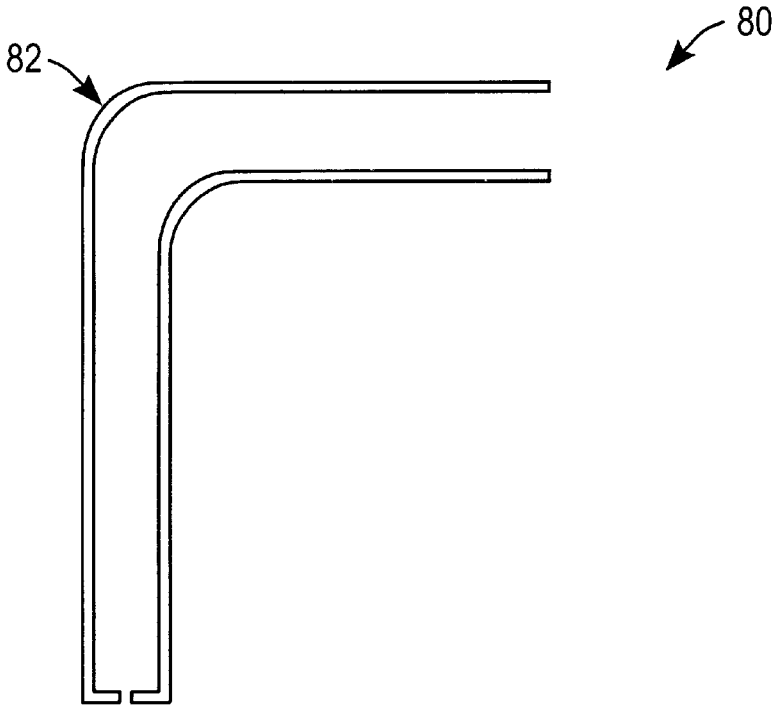

Referring to FIG. 5, in an alternative embodiment, an EMI-shielding strain relief boot 80 includes a preformed bend 82 (e.g., a 90° bend) that defines a curved path through which transmission cable 14 may extend. This embodiment may be used where transmission cable 14 must be bent as it leaves connector 16. Such a right-angled strain relief system prevents kinking of transmission cable 14 as it leaves connector 16 and avoids bending of transmission cable 14 beyond the critical bend radius.

Figure 6A:
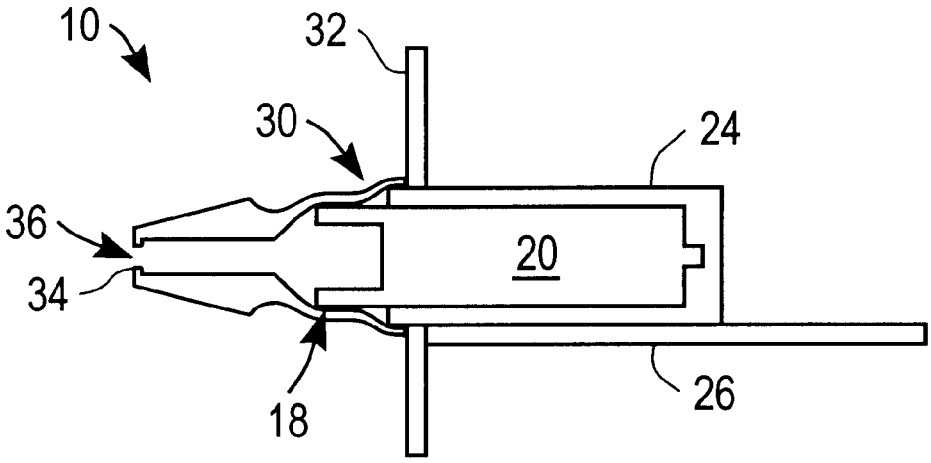
FIG. 6A is a diagrammatic cross-sectional side view of an EMI-shielding strain relief boot disposed over the interface between a transceiver module and a transceiver receptacle.
Figure 6B:
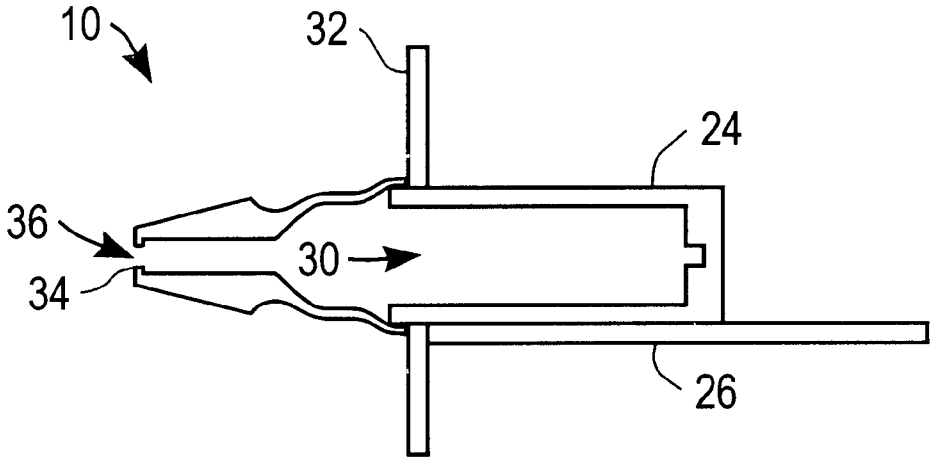
FIG. 6B is a diagrammatic cross-sectional side view of an EMI-shielding strain relief boot disposed over the receptacle opening in the rear panel of an electronic equipment enclosure.

As shown in FIGS. 6A and 6B, any of the above-described EMI-shielding strain relief boot embodiments (boot 10 is shown here for illustrative purposes only) may be disposed over the ends of transceiver connector 18 and transceiver receptacle 24 (FIG. 6A), or over the end of an empty transceiver receptacle 24 (FIG. 6B). In this embodiment, the EMI-shielding boot prevents interfering electromagnetic radiation from escaping the electronic equipment enclosure through mounting panel opening 30 and from being released from the interface between transceiver module 20 and transceiver receptacle 24. Because the size of boot opening 36 is relatively small (e.g., 2–4 mm), very little EMI would escape from boot 10; the remaining EMI would reflect back into the electronic equipment enclosure or be absorbed by the EMI shield of boot 10.

Figure 7A:
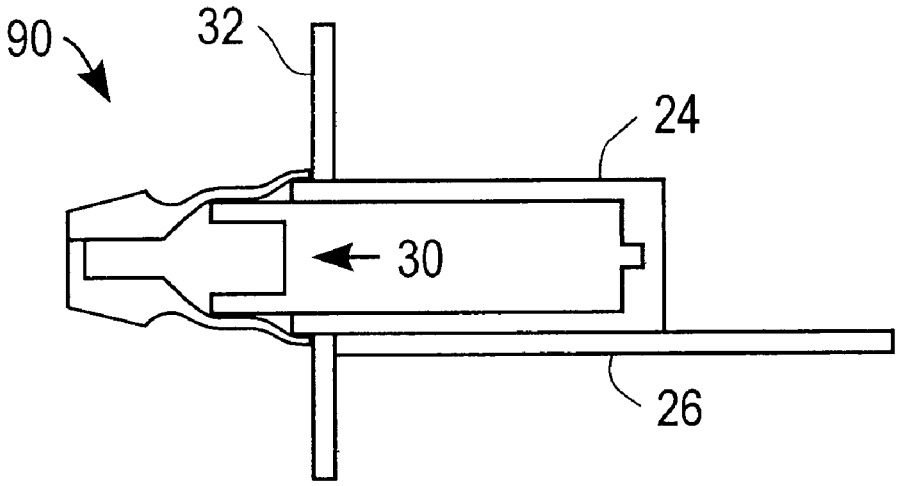
FIG. 7A is a diagrammatic cross-sectional side view of an EMI-shielding dust cover disposed over the interface between a transceiver module and a transceiver receptacle.
Figure 7B:
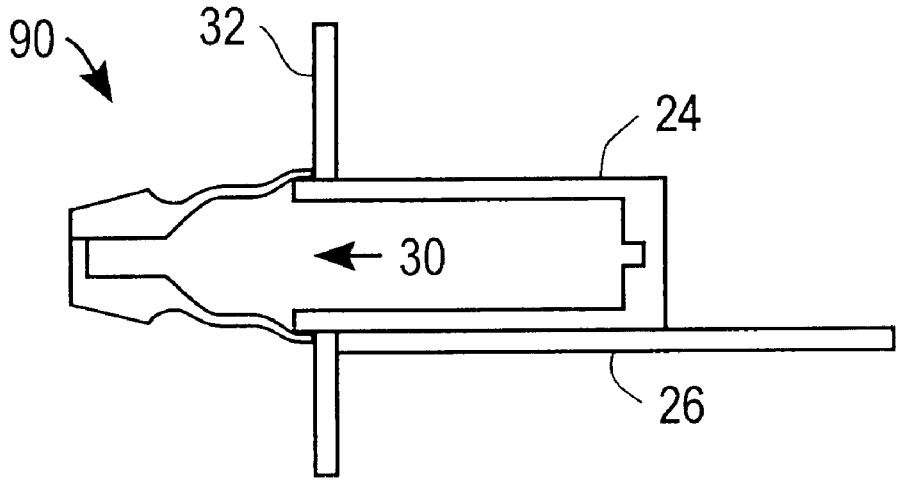
FIG. 7B is a diagrammatic cross-sectional side view of an EMI-shielding dust cover disposed over the receptacle opening in the rear panel of an electronic equipment enclosure.

Referring to FIGS. 7A and 7B, in an alternative embodiment, the proximal opening of any of the above-described EMI-shielding strain relief boot embodiments may be sealed to form an EMI-shielding dust cover 90. In this embodiment, the EMI-shielding dust cover prevents interfering electromagnetic radiation from escaping the electronic equipment enclosure through mounting panel opening 30 and from being released from the interface between transceiver module 20 and transceiver receptacle 24. The integral EMI shield of dust cover 90 extends through the proximal seal to prevent EMI from escaping. In this way, dust cover 90 extends the electrical shielding properties of the electronic equipment enclosure.

Other embodiments are within the scope of the claims. For example, the flexibility and conformability of the distal ends of the above-described EMI-shielding strain relief boots and dust covers may be achieved in a variety of ways other than tapering the radial thickness of the boot near its distal end. The material composition of the boots and dust covers may be changed from a stiffer material near the central region to a more flexible material near the distal end. The material composition may vary gradually and uniformly, or it may vary rapidly (e.g., in an exponentially-decaying manner or as a step function). Alternatively, the boot (or dust cover) may be formed from one or more different material layers of different flexibility, wherein the relative thickness of the more flexible material may increase near the distal end of the boot (or dust cover).

Various features of the above-described EMI-shielding strain relief boot (or dust cover) embodiments may be combined into a single boot (or dust cover) embodiment.

What is claimed is:

1. A strain relief boot, comprising a flexible elongated boot body having a proximal end, a distal end, and an inner surface defining a bore sized and arranged to contain an end portion of a transmission cable and an associated cable connector, and a flexible electromagnetic interference (EMI) shield extending along a substantial length of the boot body to and including an exposed outer surface of the distal end and configured to shield a region of the bore from interfering electromagnetic radiation, wherein the distal end of the boot body and EMI shield are slidable over the cable connector and are deformable so that the EMI shield conforms to and envelopes a portion of a connector that is adapted to connect to the cable connector.

2. The strain relief boot of claim 1, wherein the EMI shield comprises an electrical conductor.

3. The strain relief boot of claim 2, wherein the EMI shield comprises a plurality of electrically conductive particles.

4. The strain relief boot of claim 2, wherein the EMI shield comprises a plurality of electrically conductive wires.

5. The strain relief boot of claim 2, wherein the EMI shield is incorporated into the boot body.

6. The strain relief boot of claim 2, wherein the EMI shield comprises an electrically conductive layer disposed on the inner surface of the boot body.

7. The strain relief boot of claim 2, wherein the EMI shield comprises magnetic material.

8. The strain relief boot of claim 1, wherein the boot body inner surface defines a bore with a uniform radial dimension from the proximal end to the distal end of the boot body.

9. The strain relief boot of claim 1, wherein the radial thickness of the boot body tapers from a central region of the boot body towards the proximal end of the boot body and towards the distal end of the boot body.

10. The strain relief boot of claim 1, wherein the boot body is configured to limit bending of the transmission cable near the cable connector beyond a critical bend radius of the transmission cable.

11. The strain relief boot of claim 1, wherein the boot body comprises an exposed outer surface with one or more gripping features.

12. The strain relief boot of claim 1, further comprising a proximal flange coupled to the proximal end of the boot body and defining an opening sized to engage the cable connector while accommodating the end portion of the transmission cable.

13. The strain relief boot of claim 1, further comprising a distal flange coupled to the distal end of the boot body and protruding outwardly away from the bore.

14. The strain relief boot of claim 1, wherein the distal end of the boot body has an inner surface that flares outwardly away from the bore.

15. The strain relief boot of claim 1, wherein the EMI shield extends to an exposed surface of the distal end of the boot body.

16. The strain relief boot of claim 1, wherein the boot body comprises an elastomer.

17. The strain relief boot of claim 1, wherein the bore defines a curves path through which the transmission cable may extend.

18. A method of electromagnetically shielding an opening in an electronic apparatus enclosure, comprising attaching the strain relief cable boot of claim 1 over a flange protruding from the opening in the electronic apparatus enclosure.

19. A strain relief boot, comprising:

a flexible elongated boot body having a proximal end, a distal end, and an inner surface defining a bore with a uniform radial dimension from the proximal end to the distal end, the thickness between the inner surface and an exposed outer surface of the boot body tapering from a central longitudinal region toward the proximal end of the boot body and toward the distal end of the boot body; and a flexible electromagnetic interference (EMI) shield extending along a substantial length of the boot body to and including an exposed surface of the distal end of the boot body, the EMI shield being formed from an electrically conductive material and configured to shield a region of the bore from interfering electromagnetic radiation.

20. The strain relief boot of claim 19, further comprising a distal flange coupled to the distal end of the boot body and protruding away from the bore.

21. A strain relief boot, comprising:

a flexible elongated boot body having a proximal end, a distal end, and an inner surface defining a bore with a uniform radial dimension from the proximal end to the distal end, the thickness between the inner surface and an exposed outer surface of the boot body tapering from a central longitudinal region toward the proximal end of the boot body and toward the distal end of the boot body, wherein the distal end of the boot body has an inner surface that flares outwardly away from the bore; and a flexible electromagnetic interference (EMI) shield extending along a substantial length of the boot body to an exposed surface of the distal end of the boot body, the EMI shield being formed from an electrically conductive material and configured to shield a region of the bore from interfering electromagnetic radiation.

22. The strain relief boot of claim 19, wherein the EMI shield comprises a magnetic material.

23. The strain relief boot of claim 19, wherein the EMI shield is incorporated into the boot body.

24. The strain relief boot of claim 19, wherein the boot body comprises an elastomer.

25. The strain relief boot of claim 19, wherein the boot body is configured to limit the bend radius of the transmission cable near the cable connector.

26. A data transmission system, comprising:

a pluggable transceiver and an associated transceiver connector;

a transmission cable and an associated cable connector sized and arranged to engage the pluggable transceiver connector; and a strain relief boot comprising a flexible elongated boot body having a proximal end, a distal end, and an inner surface defining a bore sized and arranged to contain an end portion of the transmission cable and the associated cable connector, and a flexible electromagnetic interference (EMI) shield extending along a substantial length of the boot body to and including an exposed surface of the distal end and configured to shield a region of the bore from interfering electromagnetic radiation, wherein the distal end of the boot body and the flexible EMI shield are slidable over the cable connector and are deformable to envelop about an interface between the transmission cable connector and the pluggable transceiver connector.

27. The system of claim 26, wherein the pluggable transceiver is insertable into a transceiver receptacle of an electronic apparatus enclosure, the transceiver receptacle has a proximal end defining an opening for receiving the pluggable transceiver, and the distal end of the boot body is slidable over the cable connector and is conformable to and envelopable about the proximal end of the transceiver receptacle.

28. The strain relief of claim 27, wherein the EMI shield extends to the distal end of the boot body to electrically couple to the transceiver receptacle.

29. A dust cover, comprising:

a flexible elongated dust cover body having a proximal end, a distal end, and an inner surface defining a bore sized and arranged to contain a flange protruding from an opening in an electronic apparatus enclosure; and a flexible electromagnetic interference (EMI) shield extending along a substantial length of the dust cover body to and including an exposed surface of the distal end and configured to shield a region of the bore from interfering electromagnetic radiation;

wherein the distal end of the dust cover body the and EMI shield are deformable and positioned to envelop about the flange protruding from the opening in the electronic apparatus enclosure.

30. A method of electromagnetically shielding an opening in an electronic apparatus enclosure, comprising attaching the dust cover of claim 29 over a flange protruding from the opening in the electronic apparatus enclosure.

* * * * *